US007743762B2

(12) United States Patent
Larsen

(10) Patent No.: US 7,743,762 B2
(45) Date of Patent: Jun. 29, 2010

(54) THIN PROFILE DOOR FOR A COOKING APPLIANCE

(75) Inventor: Christopher A. Larsen, Dorchester, MA (US)

(73) Assignee: Maytag Corporation, Benton Harbor, MI (US)

( * ) Notice: Subject to any disclaimer, the term of this patent is extended or adjusted under 35 U.S.C. 154(b) by 854 days.

(21) Appl. No.: 11/085,083

(22) Filed: Mar. 22, 2005

(65) Prior Publication Data

US 2006/0213500 A1 Sep. 28, 2006

(51) Int. Cl.
*F24C 15/30* (2006.01)

(52) U.S. Cl. ..... 126/190; 126/273 R

(58) Field of Classification Search ..... 126/190, 126/37 R, 214 A, 214 B, 198
See application file for complete search history.

(56) References Cited

U.S. PATENT DOCUMENTS 1,798,115 A 3/1931 Antrim
1,829,948 A 11/1931 Sherman
2,682,263 A 6/1954 Brodbeck
3,289,664 A * 12/1966 Hewitt ..... 126/37 R
3,376,861 A * 4/1968 Bach, Jr. ..... 126/37 R
4,683,871 A 8/1987 Salvi
4,892,085 A 1/1990 Salvi
5,265,954 A * 11/1993 Keil ..... 312/405
5,375,587 A * 12/1994 Ward et al. ..... 126/190
6,224,179 B1 * 5/2001 Wenning et al. ..... 312/406

* cited by examiner

*Primary Examiner*—Steven B McAllister
*Assistant Examiner*—Sarah Suereth
(74) *Attorney, Agent, or Firm*—John W. Morrison; Diederiks & Whitelaw PLC

(57) ABSTRACT

A cooking appliance includes an oven cavity, a trim element and a door designed to pivot about a substantially vertical axis. The door is mounted for pivotal movement relative to the oven cavity about a substantially vertical axis. The door includes a main body portion having a front surface, a rear surface and a peripheral edge portion. The peripheral edge portion includes top, bottom and opposing side edge sections, with each of the opposing side edge sections leading to an extended region that overlaps, at least in part, the trim element. The extended region includes a generally rounded portion directly adjacent to the trim element. The generally rounded portion provides clearance necessary to enable the door to shift between open and closed positions, while simultaneously allowing the use of an extremely thin or low profile door.

20 Claims, 2 Drawing Sheets

THIN PROFILE DOOR FOR A COOKING APPLIANCE

BACKGROUND OF THE INVENTION

1. Field of the Invention

The present invention pertains to the art of cooking appliances and, more particularly, to a thin profile door assembly for a cooking appliance that creates a substantially seamless transition between the door assembly and adjacent kitchen wall structure.

2. Discussion of the Prior Art

Ovens and their general construction are well known. In general, an oven includes a cooking cavity having an opening which is selectively closed by a door assembly. Usually, ovens are of two general configurations: the ovens are either built-in units, i.e. built into a cabinet or wall, or the oven is free standing and, in most cases, is provided with a cooktop. Ovens that are built into a cabinet, wall or other similar structure are typically provided with a trim piece that overlaps adjacent cabinetry to establish a smooth transition between the oven and the adjacent structure.

Ovens are generally provided with a door having a square-shaped peripheral edge that extends over, at least in part, the trim piece. By overlapping the trim piece, the door creates a stepped transition between the oven and adjacent structure. That is, edge portions of the door overlap the trim piece forming a step-like appearance. When constructing a door, it is necessary to establish or maintain a gap between the peripheral edge of the door and the trim piece. The gap allows the door to pivot between open and closed positions. The overall size or width of the gap is dependent upon the location of a pivot point of the door. Certainly, the gap must be at least large enough to allow the square-shaped edge of the door to clear the trim piece.

In the highly competitive field of home appliances, consumer preferences are a major factor governing the construction of a given appliance line. More specifically, it has been found that consumers equate certain features of an appliance with product quality. One such feature has been found to be the overall distance a wall-type oven protrudes or extends beyond an adjacent structure. Oven doors require insulation to limit heat conduction from the oven cavity and reaching external oven surfaces. Thus, oven doors, particularly those incorporating a viewing window, will necessarily require a minimum thickness. In order to maintain a minimal distance from an external surface of the door and the trim piece, a low profile hinge must be employed. However, employing a low profile hinge requires the presence of a substantial gap between the oven door and the trim piece.

Another feature that consumers equate with product quality is the size of the gap between the door and the oven, principally when the door is in an open position. The size of the gap is of particular concern in oven designs that employ a door that pivots about a substantially vertical axis. Thus, if an appliance is provided with a thin profile door, the existence of a large gap necessitating the use of a low profile hinge may give certain consumers an impression of low quality.

Therefore, despite the existence of various oven door arrangements in the prior art, there still exists a need for a low profile oven door. More specifically, there exists a need for a low profile oven door that pivots about a vertical axis, while maintaining both a minimal distance between an outer door surface and surrounding trim and simultaneously ensuring a minimal gap exists between the oven door and the remainder of the oven itself.

SUMMARY OF THE INVENTION

The present invention is directed to a cooking appliance in the form of a cabinet mounted wall oven. The cooking appliance includes an oven cavity having top, bottom, rear and opposing side walls that collectively define a frontal opening. The oven is provided with a trim element that establishes a substantially smooth transition between the appliance and adjacent kitchen structure. The door is pivotally mounted for movement relative to the oven cavity for selectively closing the frontal opening. The door includes a main body portion having a front surface, a rear surface and a peripheral edge portion. More specifically, the peripheral edge portion includes top, bottom and opposing side edge sections, with each of the opposing side edge sections having an extended region that overlaps, at least in part, the trim element.

In accordance with the most preferred form of the invention, the extended region includes an extended radius or generally rounded portion positioned adjacent to the trim element. The generally rounded portion provides the necessary clearance to accommodate shifting of the door between open and closed positions, while simultaneously enabling the use of a thin or low profile door. The thin profile door or, more specifically, the overall thickness of the door that satisfies the meaning of thin profile, is judged by a distance from the front surface of the door to the trim element. In further accordance with the most preferred form of the invention, the generally rounded portion enables the use of an oven door having a face portion that protrudes about the same distance as a cabinet door or drawer beyond adjacent cabinetry, preferably approximately ½ inch-1 inch (1.27 cm-2.54 cm) and, most preferably, approximately ¾ inch (1.9 cm).

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
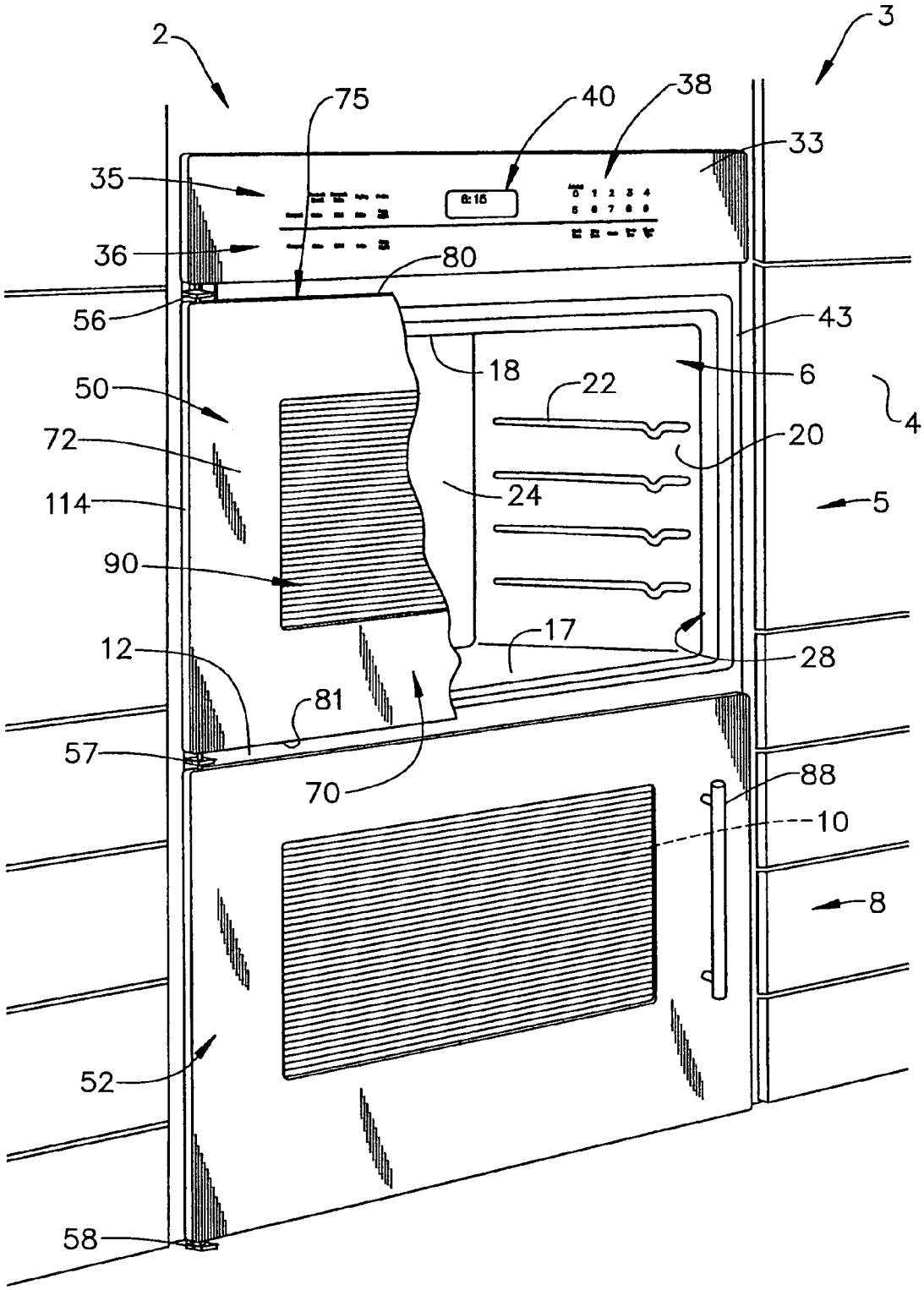
FIG. 1 is an upper-right perspective view of a cooking appliance including a thin profile door assembly constructed in accordance with the present invention.

With initial reference to FIG. 1, a cooking appliance constructed in accordance with the present invention is generally indicated at 2. Cooking appliance 2, as depicted, constitutes a double wall oven built-in to adjacent cabinetry 3. In the embodiment shown, cabinetry 3 includes doors and/or drawers, one of which is indicated at 4, that provide access to interior storage zones (not separately labeled). However, it should be understood that the present invention may be incorporated into various types of oven configurations, e.g., single wall oven units. In any event, cooking appliance 2 constitutes a dual oven wall unit including an upper oven 5 having an upper oven cavity 6 and a lower oven 8 having a lower oven cavity 10. Cooking appliance 2 is also shown to include a frame 12 for supporting both upper and lower cavities 6 and 10 within adjacent wall and/or cabinet structure.

Figure 2:
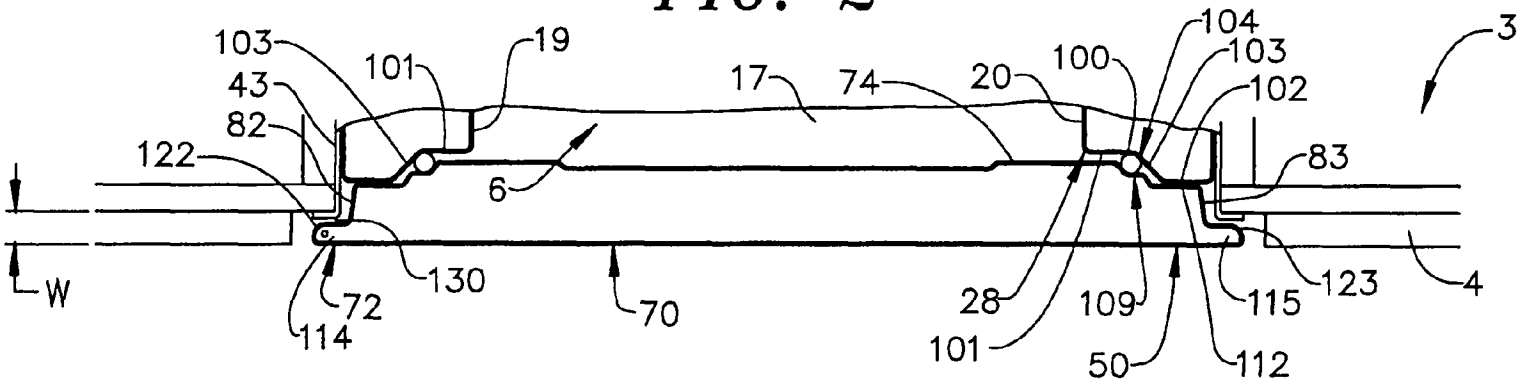
FIG. 2 is a partial cross-sectional view of an upper front portion of the thin profile door assembly illustrated in a closed position.
Figure 3:
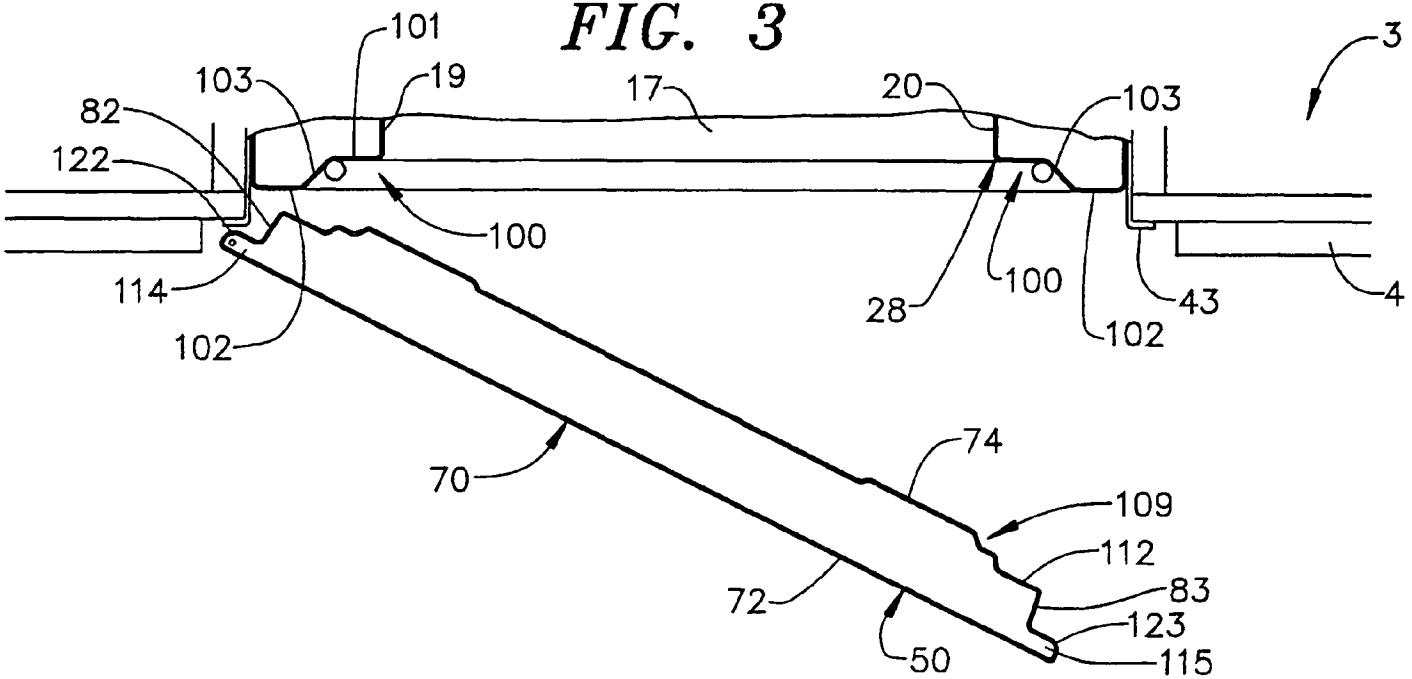
FIG. 3 is a partial cross-sectional view of an upper front portion of the thin profile door assembly of FIG. 2 shown in an open position.

As best seen in FIGS. 1-3, oven cavity 6 is defined by a bottom wall 17, a top wall 18, opposing side walls 19 and 20 provided with a plurality of vertically spaced side rails 22, and a rear wall 24. In a manner known in the art, bottom, top and opposing side walls 17-20 collectively define a frontal opening 28. Although not shown, it should be understood that oven cavity 6 can be provided with various types of heat sources for performing a selected cooking operation, e.g., gas burners, sheathed electric heating elements, a convection cooking system, and/or a microwave generator.

As further shown in FIG. 1, cooking appliance 2 includes an upper control panel 33 having a plurality of control elements. In accordance with one arrangement, the control elements are constituted by first and second sets of oven control buttons 35 and 36, as well as a numeric pad 38 and a display 40. Control panel 33 is adapted to be used to input desired cooking parameters. More specifically, first and second sets of control buttons 35 and 36, in combination with numeric pad 38 and display 40, enable a user to establish particular cooking operations for upper and lower ovens 5 and 8 respectively. As the manner in which cooking appliance 2 is programmed is known in the art and does not form part of the present invention, it will not be discussed further herein. Cooking appliance 2 is shown mounted to cabinetry 3 through a trim piece 43 which establishes a substantially smooth transition between cooking appliance 2 and adjacent structure. That is, in addition to acting as a mounting interface, trim piece 43 enables cooking appliance 2 to blend into or match existing cabinetry and/or wall structure to provide a more aesthetic appearance.

In accordance with the invention, cooking appliance 2 includes an upper door 50 provided to selectively enable access to upper oven cavity 6. Likewise, cooking appliance 2 is shown to include a lower door 52 which provides access to lower oven cavity 10. Upper and lower doors 50 and 52 are pivotally mounted relative to corresponding oven cavities 6 and 10 through a plurality of hinges 56-58. In accordance with the embodiment shown, doors 50 and 52 are adapted to pivot about a substantially vertical axis. At this point, it should be noted that each door 50 and 52 is constructed substantially identically such that a detailed description will be made with respect to door 50 with an understanding that door 52 includes corresponding structure. In further accordance with the invention, door 50 includes a main body portion 70 having a front surface 72, a rear surface 74 (FIG. 2) and a peripheral edge portion 75. Peripheral edge portion 75 includes top, bottom and opposing side edge sections 80-83 (FIG. 2). For the sake of completeness, door 50 is shown to include a handle 88 and a window 90 which enables a consumer to view the contents of oven cavity 6 during a cooking operation.

Referring to FIGS. 2 and 3, frontal opening 28 of oven cavity 6 is shown to include a recessed area 100. Recessed area 100 is formed by a front surface 101 leading to a face portion 102 through an angled section 103. Nested within recessed area 100 is a seal 104 which, in a manner that will be described more fully below, is adapted to be engaged by rear surface 74 of door 50 to prevent oven gases generated during a cooking operation from escaping oven cavity 6. Towards that end, rear surface 74 includes a corresponding recessed portion 109 which is adapted to receive seal 104. In accordance with the embodiment shown, recessed portion 109 leads to a sealing surface 112. Sealing surface 112 is juxtaposed face portion 102 when door 50 is in a closed position. As further shown in these figures, sealing surface 112 leads through side edge sections 82 and 83 before terminating in respective first and second extended regions 114 and 115. As best shown in FIG. 2, when door 50 is in a closed position, side edge sections 82 and 83 are actually recessed within trim piece 43, while first and second extended regions 114 and 115 overlap, at least in part, a front surface (not separately labeled) of trim piece 43. Preferably, first and second extended regions completely overlap the front surface of trim piece 43.

In accordance with the most preferred form of the invention, each extended region 114 and 115 includes a corresponding rounded portion 122 and 123 having an enlarged radius that is arranged so as to be adjacent trim piece 43. With this arrangement, the enlarged radius establishes a minimal clearance or gap, indicated generally at 130, that is required between first and second extended portions 114 and 115 and trim piece 43. Gap 130 allows door 50 to shift between open and closed positions without hitting trim piece 43. That is, in order to allow door 50 to readily shift between the closed position shown in FIG. 2 to an open position as represented in FIG. 3, gap 130 must exist between extended portion 114 and trim piece 43. However, in accordance with the invention, in addition to minimizing the thickness of extended portion 114, it is desired to minimize gap 130. To this end, the incorporation of rounded portion 122 enables gap 130 to be set to a minimum level. With this overall arrangement, a minimum overall distance "W" can be maintained between front surface 72 of door 50 and a rear surface (not separately labeled) of trim piece 43. By minimizing distance "W", a more seamless appearance is provided for cooking appliance 2 such that door 50 covers trim piece 43, while blending with adjacent cabinetry 3. Preferably, the distance "W", is in a range of approximately ½ inch to 1 inch (1.27 cm-2.54 cm), and most preferably, approximately ¾ inches (1.9 cm). In this way, the present invention establishes a thin profile door. By thin profile, it is meant that doors 50 and 52, when closed, preferably do not extend beyond closed cabinetry doors or drawers 3. Most preferably, front surfaces 72 of doors 50 and 52 are arranged substantially co-planar with the outer surfaces (not separately labeled) of the cabinetry doors or drawers 3.

Although described with reference to a preferred embodiment of the invention, it should be readily understood that various changes and/or modifications can be made to the invention without departing from the spirit thereof. In general, the invention is only intended to be limited by the scope of the following claims.

I claim:

1. A cooking appliance adapted to be mounted adjacent kitchen cabinetry comprising:

an oven cavity including top, bottom, rear, and opposing side walls that collectively define a frontal opening having a front face portion;

at least one trim element extending along the oven cavity and having an outer surface projecting forward of the front face portion to establish a substantially smooth transition between the cooking appliance and adjacent kitchen cabinetry; and a door pivotally mounted for movement relative to the oven cavity for selectively closing the frontal opening, said door including a main body portion having a front surface, a rear surface and a peripheral edge portion, said peripheral edge portion including top, bottom and opposing side edge sections, each of said opposing side edge sections extending away from the front face portion of the oven cavity adjacent the at least one trim element, while including a laterally extended region that overlaps, at least in part, the at least one trim element, each extended region extends laterally outwardly of the oven cavity and leads to the front surface portion of the door, at least one of said extended regions including a rounded portion and is hinged adjacent the at least one trim element, with the rounded portion enabling the door to shift between open and closed positions while simultaneously enabling the door to be thin, as judged by a distance from the front surface of the door to the at least one trim element.

2. The cooking appliance according to claim 1, wherein the extended region of each of the opposing side section completely covers the at least one trim element.

3. The cooking appliance according to claim 1, wherein the door pivots about a substantially vertical axis that extends through the at least one of the extended regions.

4. The cooking appliance according to claim 3, wherein the oven cavity forms part of a wall oven.

5. The cooking appliance according to claim 1, wherein the front surface of the door is spaced from a rear surface of the at least one trim element a distance between approximately ½-inch to 1-inch.

6. The cooking appliance according to claim 5, wherein the front surface of the door is spaced from the rear surface of the at least one trim element a distance of approximately ¾-inch.

7. A cooking appliance system comprising:

a cabinet having a front face portion, a storage zone, and at least one of a cabinet door and a drawer;

an oven cavity including top, bottom, rear and opposing side walls that collectively define a frontal opening, the oven cavity adjacent the cabinet;

at least one trim element extending along the oven cavity, said at least one trim element abutting the front face portion of the cabinet;

a thin profile door pivotally mounted for movement relative to the oven cavity, said thin profile door including a main body portion having a front surface, a rear surface and a peripheral edge portion, said peripheral edge portion including an extended region; and means for establishing a minimal clearance between the thin profile door at the extended region and that at least one trim element, while enabling said thin profile door to be shiftable between a first position exposing the frontal opening and a second position covering the frontal opening wherein, when in the second position, the front surface of the door does not extend beyond the at least one of the cabinet door and the drawer.

8. The cooking appliance according to claim 7, wherein the peripheral edge portion includes top, bottom and opposing side edge sections, at least one of said opposing side edge sections including the extended region, and said establishing means constitutes a rounded portion of the extended region juxtaposed the at least one trim element, said extended region overlapping, at least in part, the at least one trim element.

9. The cooking appliance according to claim 8, wherein the extended region completely covers the at least one trim element.

10. The cooking appliance according to claim 8, wherein the thin profile door pivots about a substantially vertical axis that extends through the extended region.

11. The cooking appliance according to claim 10, wherein the oven cavity forms part of a wall oven.

12. The cooking appliance according to claim 7, wherein the front surface of the thin profile door is spaced from a rear surface of the at least one trim element a distance between approximately ½-inch to 1-inch.

13. The cooking appliance according to claim 12, wherein the front surface of the thin profile door is spaced from the rear surface of the at least one trim element a distance of approximately ¾-inch.

14. The cooking appliance according to claim 7, wherein the front surface of the thin profile door is substantially coplanar with a front surface of the at least one of the cabinet door and the drawer.

15. A cooking appliance system comprising:

at least one cabinet having a front face portion, a storage zone, and at least one of a cabinet door and a drawer;

an oven cavity including top, bottom, rear and opposing side walls that collectively define a frontal opening having a front face portion, the oven cavity adjacent the cabinet;

at least one trim element extending along the oven cavity, said at least one trim element abutting the front face portion of the cabinet; and a door pivotally mounted for movement relative to the oven cavity for selectively closing the frontal opening, said door including a main body portion having a front surface, a rear surface and a peripheral edge portion, said peripheral edge portion including top, bottom and opposing side edge sections, each of said opposing side edge sections including an extended region that overlaps, at least in part, the at least one trim element and the front face portion of the cabinet and, at least one of said extended regions defining a hinge side of the door and having an enlarged radius, wherein the at least one cabinet is positioned, at least in part, laterally outward of the hinge side of the door and the enlarged radius establishes a minimal gap between the at least one of the extended regions and the at least one trim element in order to allow the door to shift between open and closed positions, while simultaneously ensuring that the front surface of the door does not extend beyond the at least one of the cabinet door and the drawer when in the closed position.

16. The cooking appliance according to claim 15, wherein the at least one of the extended regions completely covers the at least one trim element.

17. The cooking appliance according to claim 15, wherein the door pivots about a substantially vertical axis that extends through the at least one of the extended regions defining the hinge side of the door.

18. The cooking appliance according to claim 17, wherein the oven cavity forms part of a wall oven.

19. The cooking appliance according to claim 15, wherein the front surface of the thin profile door is spaced from a rear surface of the at least one trim element a distance between approximately ½-inch to 1-inch.

20. The cooking appliance according to claim 15, wherein the front surface of the door is substantially coplanar with a front surface of the at least one of the cabinet door and the drawer.

* * * * *